US009042768B2

(12) United States Patent
No

(10) Patent No.: US 9,042,768 B2
(45) Date of Patent: May 26, 2015

(54) CLEANING MEMBER, TRANSFER DEVICE, INTERMEDIATE TRANSFER DEVICE, AND IMAGE FORMING APPARATUS

(71) Applicant: FUJI XEROX CO., LTD., Minato-ku, Tokyo (JP)

(72) Inventor: Hiroshi No, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 13/943,226

(22) Filed: Jul. 16, 2013

(65) Prior Publication Data

US 2014/0286672 A1 Sep. 25, 2014

(30) Foreign Application Priority Data

Mar. 21, 2013 (JP) ..... 2013-058814

(51) Int. Cl.
*G03G 15/16* (2006.01)
*G03G 21/00* (2006.01)

(52) U.S. Cl.
CPC ..... *G03G 15/168* (2013.01); *G03G 21/0029* (2013.01)

(58) Field of Classification Search
USPC ..... 399/350, 101, 351
See application file for complete search history.

(56) References Cited

U.S. PATENT DOCUMENTS

| | | | | |
|---|---|---|---|---|
| 7,660,556 | B2 * | 2/2010 | Saitsu et al. | 399/407 |
| 7,715,778 | B2 * | 5/2010 | Sugimoto | 399/350 |
| 7,817,956 | B2 * | 10/2010 | Sugimoto | 399/350 |
| 8,275,302 | B2 * | 9/2012 | Sako et al. | 399/350 |
| 2009/0257797 | A1 * | 10/2009 | Arai et al. | 399/350 |
| 2010/0239329 | A1 * | 9/2010 | Kitani et al. | 399/285 |
| 2010/0247188 | A1 * | 9/2010 | Fukuda et al. | 399/350 |

FOREIGN PATENT DOCUMENTS

| | | | | | |
|---|---|---|---|---|---|
| JP | 61-59472 | A | | 3/1986 | |
| JP | 61059472 | A | * | 3/1986 | G03G 21/00 |
| JP | 61-212881 | A | | 9/1986 | |
| JP | 1-235985 | A | | 9/1989 | |
| JP | 01235985 | A | * | 9/1989 | G03G 21/00 |
| JP | 2008-197404 | A | | 8/2008 | |

* cited by examiner

*Primary Examiner* — Clayton E Laballe
*Assistant Examiner* — Warren K Fenwick
(74) *Attorney, Agent, or Firm* — Sughrue Mion, PLLC

(57) ABSTRACT

A cleaning member includes a ridgeline part provided at one end of the cleaning member in a lateral direction of the cleaning member, the ridgeline part including a first ridgeline that extends in an axial direction of a member to be cleaned that rotates and second ridgelines provided at respective ends of the first ridgeline, each second ridgeline extending in a direction away from the member to be cleaned. The ridgeline part is pressed against an outer peripheral surface of the member to be cleaned so that the ridgeline part and a corner portion on which the ridgeline part is formed press into the outer peripheral surface of the member to be cleaned and deform the member to be cleaned.

16 Claims, 13 Drawing Sheets

FIG. 8

| EXAMPLES/ COMPARATIVE EXAMPLES | EXAMPLE 1 | EXAMPLE 2 | COMPARATIVE EXAMPLE 1 | COMPARATIVE EXAMPLE 2 |
|---|---|---|---|---|
| SHAPE | FIG. 9A | FIG. 9B | FIG. 9C | FIG. 9D |
| FL1 [mm] | 10 | 10 | 10 | 10 |
| FL2 [mm] | 10 | 12 | 10 | 12 |
| a [mm] | 0 | 5 | 0 | 5 |
| d [mm] | 2.0 | 2.0 | 2.0 | 2.0 |
| w [mm] | 334 | 334 | 334 | 334 |
| END SHAPE | C0.1 | C0.1 | CORNER SHAPE | CORNER SHAPE |

CLEANING MEMBER, TRANSFER DEVICE, INTERMEDIATE TRANSFER DEVICE, AND IMAGE FORMING APPARATUS

CROSS-REFERENCE TO RELATED APPLICATIONS

This application is based on and claims priority under 35 USC 119 from Japanese Patent Application No. 2013-058814 filed Mar. 21, 2013.

BACKGROUND

Technical Field

The present invention relates to a cleaning member, a transfer device, an intermediate transfer device, and an image forming apparatus.

SUMMARY

According to an aspect of the invention, there is provided a cleaning member including a ridgeline part provided at one end of the cleaning member in a lateral direction of the cleaning member, the ridgeline part including a first ridgeline that extends in an axial direction of a member to be cleaned that rotates and second ridgelines provided at respective ends of the first ridgeline, each second ridgeline extending in a direction away from the member to be cleaned. The ridgeline part is pressed against an outer peripheral surface of the member to be cleaned so that the ridgeline part and a corner portion on which the ridgeline part is formed press into the outer peripheral surface of the member to be cleaned and deform the member to be cleaned.

BRIEF DESCRIPTION OF THE DRAWINGS

An exemplary embodiment of the present invention will be described in detail based on the following figures, wherein:

FIG. 8 is a table showing simulation conditions for examples of the present invention and comparative examples;

DETAILED DESCRIPTION

Figure 1:
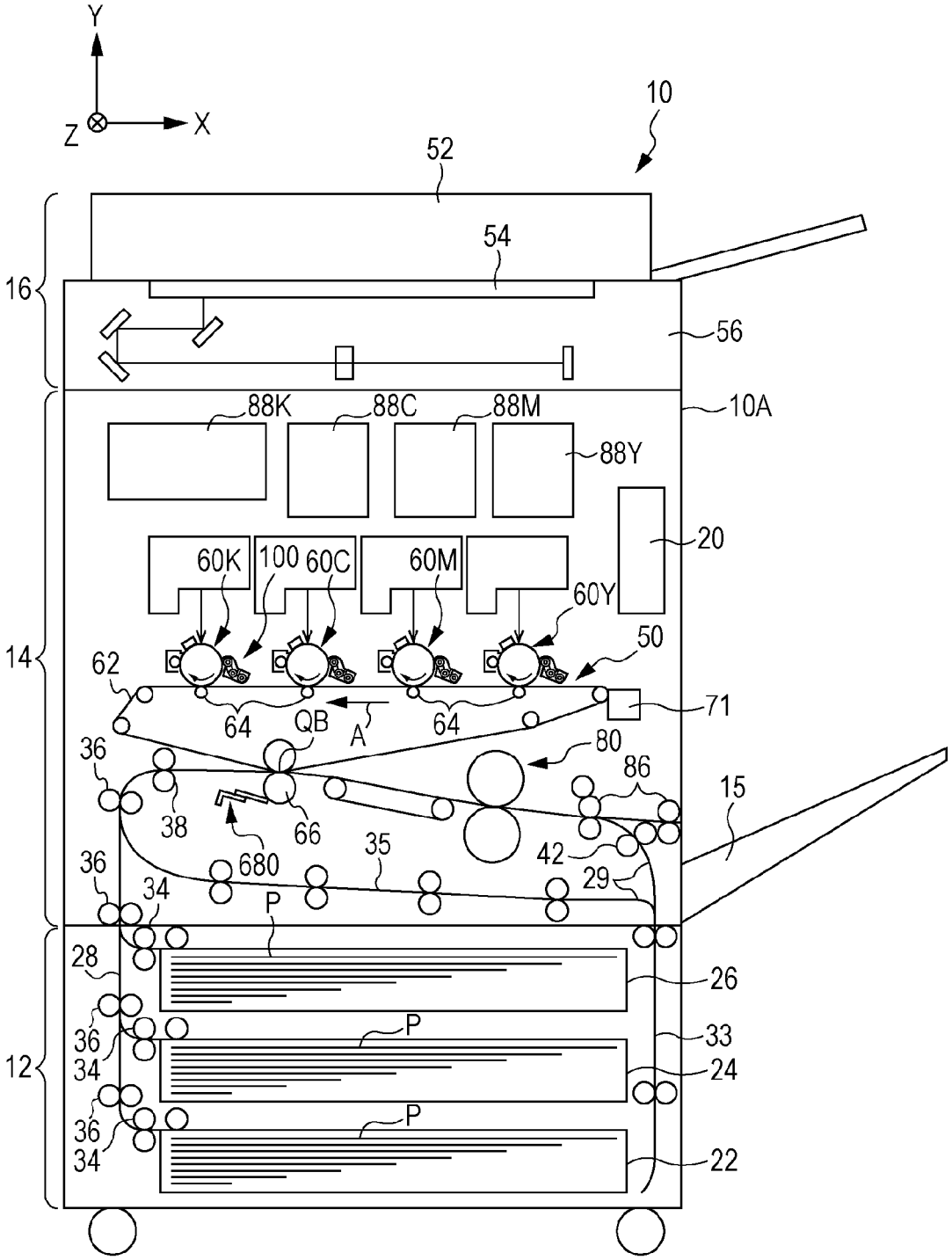
FIG. 1 illustrates the overall structure of an image forming apparatus according to an exemplary embodiment of the present invention.

An exemplary embodiment of the present invention will be described with reference to the drawings. First, the overall structure and operation of an image forming apparatus will be described. Then, specific parts of the image forming apparatus according to the exemplary embodiment of the present invention will be described. In the following description, the direction shown by arrow Y in FIG. 1 is defined as a height direction of the apparatus, and the direction shown by arrow X in FIG. 1 is defined as a width direction of the apparatus. The direction orthogonal to both the height direction and the width direction of the apparatus (direction shown by arrow Z as appropriate) is defined as a depth direction.

Overall Structure of Image Forming Apparatus

Entire Apparatus

FIG. 1 illustrates the overall structure of an image forming apparatus 10 according to an exemplary embodiment of the present invention viewed from the front. As illustrated in FIG. 1, the image forming apparatus 10 includes a sheet container section 12 in which sheets of recording paper P are contained, an image forming section 14 that forms an image on each sheet of recording paper P fed from the sheet container section 12, and a document reading section 16 which reads a document (not shown), in that order from bottom to top in the height direction of the image forming apparatus 10. The image forming section 14 includes a controller 20 that controls the operation of each section of the image forming apparatus 10. The recording paper P is an example of a medium.

Sheet Container Section

The sheet container section 12 includes a first container 22, a second container 24, and a third container 26 which contain sheets of recording paper P having different sizes. Each of the first container 22, the second container 24, and the third container 26 has a feed roller 32 that feeds the sheets of recording paper P contained therein to a transport path 28 provided in the image forming apparatus 10.

Transport Path

The transport path 28 is disposed in the sheet container section 12 and the image forming section 14, which will be described below. The transport path 28 is provided with plural pairs of transport rollers 34 and 36 that transport each sheet of recording paper P. Positioning rollers 38, which temporarily stop the sheet of recording paper P and transport the sheet of recording paper P to a second transfer position QB, which will be described below, at a predetermined timing are disposed downstream of one of the pairs of transport rollers 36 that is at the most downstream position in a transport direction of the sheet of recording paper P.

A fixing device 80 is disposed downstream of the second transfer position QB along the transport path 28 in the transport direction of the sheet of recording paper P. The fixing device 80 fixes a toner image to the sheet of recording paper P, the toner image having been formed by the image forming section 14, which will be described below, and transferred onto the sheet of recording paper P at the second transfer position QB in a second transfer process. Plural transport rollers 86 are disposed downstream of the fixing device 80 in the transport direction, so that the sheet of recording paper P to which the toner image has been fixed is transported to a paper output unit 15. The fixing device 80 will be described below.

The transport path 28 is connected to a duplex-printing transport path 29 which reverses and transports the sheet of recording paper P so that images may be formed on both sides of the sheet of recording paper P. The duplex-printing transport path 29 includes a first reversing path 33 that is provided at the right side of the image forming apparatus 10 in the width direction and that switches back the sheet of recording paper P, and a second reversing path 35 that transports the sheet of recording paper P that has been switched back by the first reversing path 33 toward the left side of the image forming apparatus 10 in the width direction. The sheet of recording paper P that has been transported along the second reversing path 35 is transported to the second transfer position QB again, and a toner image is transferred onto the back side of the sheet in the second transfer process.

Image Forming Section

Figure 2:
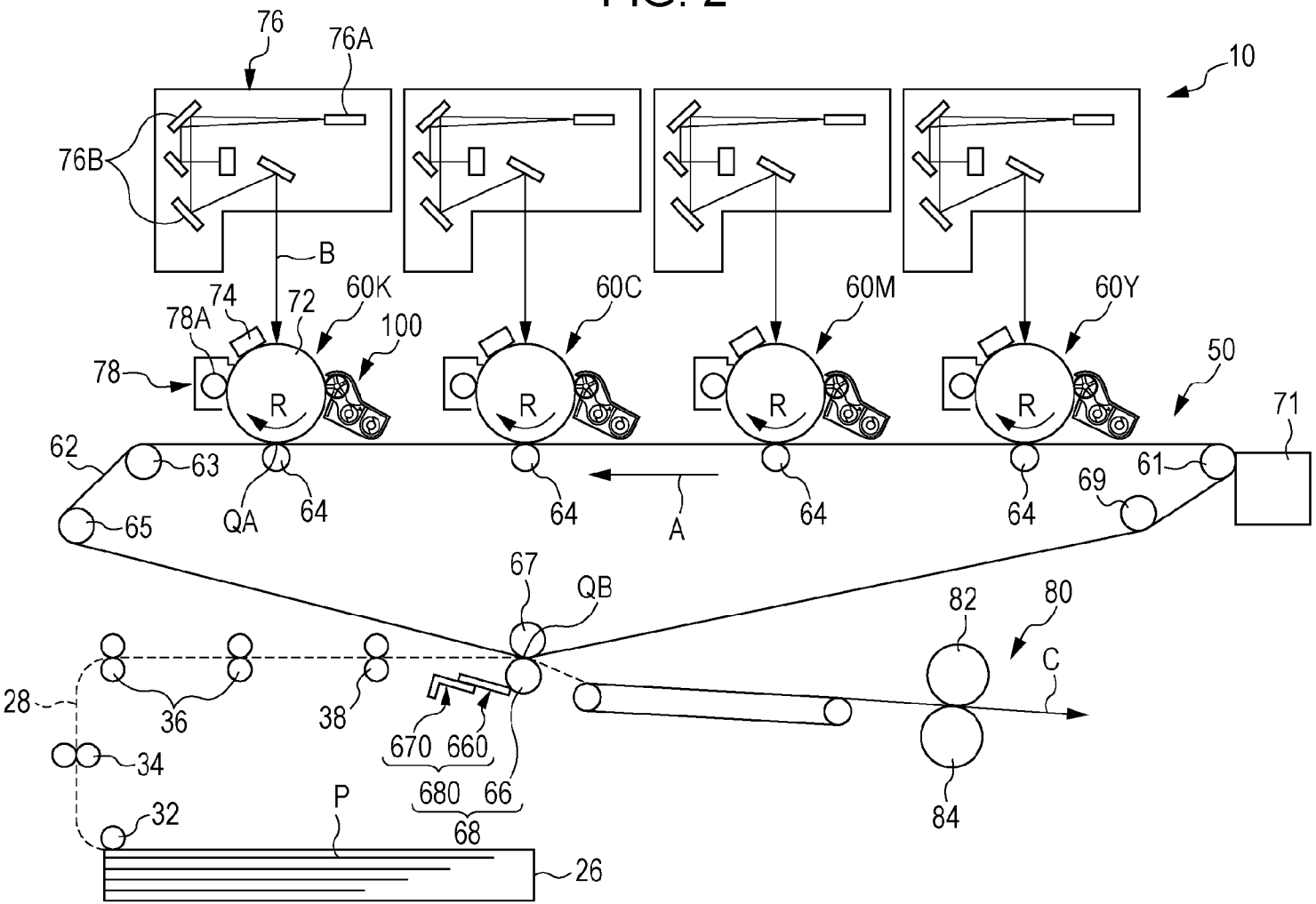
FIG. 2 illustrates the structure of an image forming section and a region around the image forming section of the image forming apparatus according to the exemplary embodiment of the present invention.

The image forming section 14 will now be described with reference to FIGS. 1 and 2. FIG. 2 illustrates the structure of the image forming section 14 and a region around the image forming section 14 of the image forming apparatus 10 according to the exemplary embodiment.

The image forming section 14 includes image forming units 60Y, 60M, 60C, and 60K that form toner images and an intermediate transfer device 50 that receives the toner images formed by the image forming units 60Y, 60M, 60C, and 60K in a first transfer process and transfers the toner images onto the sheet of recording paper P in a second transfer process.

Image Forming Units

The image forming units 60Y, 60M, 60C, and 60K form yellow (Y), magenta (M), cyan (C), and black (K) toner images, respectively. Yellow (Y), magenta (M), cyan (C), and black (K) are examples of toner colors.

In the following description, the characters Y, M, C, and K will be omitted when it is not necessary to distinguish the image forming units 60Y, 60M, 60C, and 60K corresponding to the respective colors (Y, M, C, and K) and components of the image forming units 60Y, 60M, 60C, and 60K.

Each image forming unit 60 includes a photoconductor body 72, a charging device 74, an exposure device 76, a developing device 100, and a photoconductor-body cleaning device 78. The photoconductor body 72, the charging device 74, the exposure device 76, and the developing device 100 are examples of an image carrier, a charging unit, a latent image forming unit, and a developing unit, respectively.

The above-mentioned components of the image forming unit 60 have the following functions. That is, the photoconductor body 72 carries an electrostatic latent image and a toner image on an outer peripheral surface thereof. The charging device 74 charges the outer peripheral surface of the photoconductor body 72. The exposure device 76 forms the electrostatic latent image on the photoconductor body 72 by irradiating the outer peripheral surface of the photoconductor body 72, which has been charged by the charging device 74, with light. The developing device 100 forms the toner image on the photoconductor body 72 by developing the electrostatic latent image formed on the photoconductor body 72. The photoconductor-body cleaning device 78 cleans the outer peripheral surface of the photoconductor body 72.

Photoconductor Body

As illustrated in FIGS. 1 and 2, the photoconductor body 72 has a cylindrical shape and is rotated around an axis thereof in the direction of arrow R by a drive unit (not shown). The photoconductor body 72 includes a cylinder made of aluminum and a photosensitive layer (not shown) provided on the cylinder. The photosensitive layer includes an undercoat layer, a charge generating layer, and a charge transport layer arranged in that order from the cylinder.

The photoconductor body 72 shows characteristics of an insulator in an environment where no light is incident thereon (in the image forming apparatus 10), but shows characteristics of a semiconductor in regions where the photoconductor body 72 is irradiated with light by the exposure device 76. The outer peripheral surface of the photoconductor body 72 is charged by the charging device 74, and is then irradiated with light by the exposure device 76, so that an electrostatic latent image is formed on the outer peripheral surface of the photoconductor body 72. An overcoat layer (not shown) may be additionally formed on an outer peripheral surface of the charge transport layer so that the electrostatic latent image is formed on an outer peripheral surface of the overcoat layer.

As illustrated in FIGS. 1 and 2, photoconductor bodies 72Y, 72M, 72C, and 72K on which the toner images of the respective colors are formed are arranged along a line in that order from the right side in the width direction of the image forming apparatus 10.

Charging Device

The charging device 74 negatively charges the outer peripheral surface of the photoconductor body 72. In this exemplary embodiment, the charging device 74 is a corona discharge type (non-contact charging) scorotron charging device. The charging device 74 may instead be a charging roller type (contact charging) device.

Exposure Device

The exposure device 76 includes a semiconductor laser, an f-θ lens (not shown), a polygon mirror 76A, an imaging lens (not shown), and plural mirrors 76B. In the exposure device 76, the semiconductor laser emits a laser beam B on the basis of image information corresponding to a toner image of the corresponding color. The laser beam B is reflected by the polygon mirror 76A such that the outer peripheral surface of the photoconductor body 72 that has been charged by the charging device 74 is scanned with the laser beam B, thereby forming the electrostatic latent image. The exposure device 76 may instead be of a so-called light emitting diode (LED) type.

Developing Device

The developing device 100 includes a toner supplying member that supplies the toner to the photoconductor body 72 and a transport member that transports the toner to the toner supplying member while stirring the toner.

Photoconductor-Body Cleaning Device

The photoconductor-body cleaning device 78 includes a cleaning roller 78A that extends in a direction along an axis of the photoconductor body 72 and contacts the outer peripheral surface of the photoconductor body 72. The cleaning roller 78A rotates when the photoconductor body 72 rotates, and thereby removes residual toner, dust, etc., from the outer peripheral surface of the photoconductor body 72 after the first transfer process. The photoconductor-body cleaning device 78 may instead be of a so-called cleaning blade type.

Intermediate Transfer Device

The intermediate transfer device 50 will now be described with reference to FIGS. 1 and 2. The intermediate transfer device 50 includes an intermediate transfer belt 62, plural first transfer rollers 64, a second transfer device 68, and a belt cleaning device 71. The intermediate transfer belt 62 is an example of an image carrier or an intermediate transfer body.

Intermediate Transfer Belt

The intermediate transfer belt 62 is an endless belt. The intermediate transfer belt 62 is supported by being wrapped around a drive roller 61, plural first transfer rollers 64, a support roller 63, a tension applying roller 65, an opposing roller 67, and a support roller 69.

The drive roller 61 is disposed upstream of a first transfer position QA (see FIG. 2), which will be described below, of the photoconductor body 72Y in the direction of arrow A. The drive roller 61 is connected to a drive motor (not shown) and rotates the intermediate transfer belt 62. The support roller 63 is disposed downstream of the first transfer position QA of the photoconductor body 72K in the direction of arrow A, and supports the intermediate transfer belt 62 from the inner side. The support roller 69 is disposed downstream of the first transfer position QA of the photoconductor body 72K in the direction of arrow A, and supports the intermediate transfer belt 62 from the inner side. The tension applying roller 65 is disposed downstream of the support roller 63 in the direction of arrow A, and applies a tension to the intermediate transfer belt 62.

The intermediate transfer belt 62 is made of a material that mainly contains polyimide resin and in which sub-components such as an electronic conductive material, an ion conductive material, etc., are dispersed.

First Transfer Roller

As illustrated in FIGS. 1 and 2, the first transfer rollers 64 are arranged so as to oppose the respective photoconductor bodies 72 with the intermediate transfer belt 62 interposed therebetween. A first transfer voltage is applied to each first transfer roller 64 so that an electric field is formed between the first transfer roller 64 and the outer peripheral surface of the corresponding photoconductor body 72. Each first transfer roller 64 causes the toner image formed on the outer peripheral surface of the corresponding photoconductor body 72 to be transferred onto the intermediate transfer belt 62 at the first transfer position QA.

Second Transfer Device

The second transfer device 68 includes a second transfer roller 66 and a cleaning unit 680 that contacts an outer peripheral surface of the second transfer roller 66 and removes toner, dust, etc., that have adhered to the outer peripheral surface of the second transfer roller 66.

The second transfer roller 66 opposes the opposing roller 67 with the intermediate transfer belt 62 interposed therebetween, and is pressed by the opposing roller 67 from the inner side of the intermediate transfer belt 62 so that a nip portion (second transfer position QB) is formed. The second transfer roller 66 is formed by covering an outer peripheral surface of a shaft 66B (see FIG. 3) with a foam layer (foam elastic layer) having a predetermined outer diameter. An outer peripheral surface of the foam layer is formed of an outer layer having no foamed portions (so-called skin layer). The second transfer roller 66 receives a voltage and forms an electric field between the second transfer roller 66 and the opposing roller 67, so that the toner image on the outer peripheral surface of the intermediate transfer belt 62 is transferred onto the sheet of recording paper P at the second transfer position QB.

The opposing roller 67 is a metal roller composed of an aluminum open pipe. Therefore, the second transfer roller 66 is inwardly deformed by an amount larger than an amount by which the opposing roller 67 is deformed at the second transfer position QB. In other words, rigidity of the second transfer roller 66 in the radial direction is lower than that of a metal roller, such as the opposing roller 67.

The cleaning unit 680 includes a cleaning blade 660 and a blade holder 670 that supports the cleaning blade 660. The cleaning unit 680 is pressed against the outer peripheral surface of the second transfer roller 66 and removes the toner, dust, etc., that have adhered to the outer peripheral surface of the second transfer roller 66.

The second transfer roller 66 is an example of an object to be cleaned. The cleaning blade 660 is an example of a cleaning member or a cleaning body. The cleaning unit 680 is an example of a cleaning member. The second transfer device 68 is an example of a transfer device. The cleaning blade 660, the cleaning unit 680, and the second transfer device 68 will be described in detail below.

Belt Cleaning Device

The belt cleaning device 71 is arranged so as to oppose the above-described drive roller 61 with the intermediate transfer belt 62 interposed therebetween. The belt cleaning device 71 contacts the outer peripheral surface of the intermediate transfer belt 62 and removes toner that has remained on the outer peripheral surface of the intermediate transfer belt 62 after the second transfer process and dust and the like that have adhered to the outer peripheral surface of the intermediate transfer belt 62 at the second transfer position.

Fixing Device

The fixing device 80 includes a fixing roller 82 and a pressing roller 84. The fixing roller 82 is disposed at a side of the sheet of recording paper P at which the toner image has been transferred, and contains a halogen heater (not shown). The pressing roller 84 presses the sheet of recording paper P that has been transported from a transport unit against the fixing roller 82.

Other Components of Image Forming Section

Toner cartridges 88 that contain toners of the respective colors are arranged above the image forming units 60 in the height direction of the image forming apparatus 10 in a replaceable manner. The toner cartridges 88Y, 88M, 88C, and 88K are respectively connected to the developing devices 100Y, 100M, 100C, and 100K (see FIG. 2) corresponding to the respective colors and supply the toners of the respective colors to the developing devices 100Y, 100M, 100C, and 100K.

Document Reading Section

The document reading section 16 will be described with reference to FIG. 1. The document reading section 16 includes a document transport device 52, a platen glass 54, and a document reading device 56. The document transport device 52 transports a document to be read from the position where the document has been set to an output position. The platen glass 54 is disposed below the document transport device 52, and the document may be placed on the platen glass 54. The document reading device 56 reads the document while the document is being transported by the document transport device 52 or placed on the platen glass 54.

Operation of Image Forming Apparatus

The operation of the image forming apparatus 10 will now be described with reference to FIGS. 1 and 2. The controller 20 activates the image forming apparatus 10 when the controller 20 receives image data from the document reading section 16 or an external image processing apparatus (not shown). The controller 20 converts the image data into yellow (Y), magenta (M), cyan (C), and black (K) image data items. The image data items corresponding to the respective colors are successively output to the respective exposure devices 76.

Subsequently, the exposure devices 76 emit light beams corresponding to the image data items corresponding to the respective colors, and the outer peripheral surfaces of the photoconductor bodies 72 that have been charged by the respective charging devices 74 are irradiated with the emitted light beams. Thus, electrostatic latent images corresponding to the image data items of the respective colors are formed on the outer peripheral surfaces of the photoconductor bodies 72Y, 72M, 72C, and 72K.

The electrostatic latent images formed on the outer peripheral surfaces of the photoconductor bodies 72Y, 72M, 72C, and 72K are developed by the developing devices 100Y, 100M, 100C, and 100K, respectively, into toner images of the respective colors.

The toner images of the respective colors on the outer peripheral surfaces of the photoconductor bodies 72Y, 72M, 72C, and 72K are transferred onto the outer peripheral surface of the intermediate transfer belt 62 by the first transfer rollers 64 in the first transfer process.

A sheet of recording paper P is fed from, for example, the third container 26 and transported along the transport path 28. Then, the sheet of recording paper P waits at the positioning rollers 38. The sheet of recording paper P that has been waiting at the positioning rollers 38 is transported to the second transfer position QB at the time when the intermediate transfer belt 62, on the outer peripheral surface of which the toner images have been transferred, is rotated to the second transfer position QB. The toner images that have been transferred onto the outer peripheral surface of the intermediate transfer belt 62 in the first transfer process are transferred onto the sheet of recording paper P that has been transported to the second transfer position QB by the second transfer roller 66 in the second transfer process.

Subsequently, the sheet of recording paper P on which the toner images have been transferred is transported toward the fixing device 80 in the direction of arrow C. In the fixing device 80, the toner images are heated and pressurized by the fixing roller 82 and the pressing roller 84 and are thereby fixed to the sheet of recording paper P.

The sheet of recording paper P to which the toner images have been fixed is output to the paper output unit 15 (see FIG. 1). Thus, the image forming operation is completed.

In the case where images are to be formed on both sides of the sheet of recording paper P, as illustrated in FIG. 1, the sheet of recording paper P is transported to the duplex-printing transport path 29 after the toner images have been fixed to the front surface thereof by the fixing device 80. Then, toner images are transferred onto the back surface of the sheet of recording paper P in the second transfer process and fixed to the back surface. Then, the sheet of recording paper P is output to the paper output unit 15, and the image forming operation is completed.

Structure of Specific Parts

The cleaning blade 660, the cleaning unit 680, and the second transfer device 68 according to the exemplary embodiment of the present invention will now be described with reference to FIGS. 3A, 3B, 4A, and 4B.

Figure 3B:
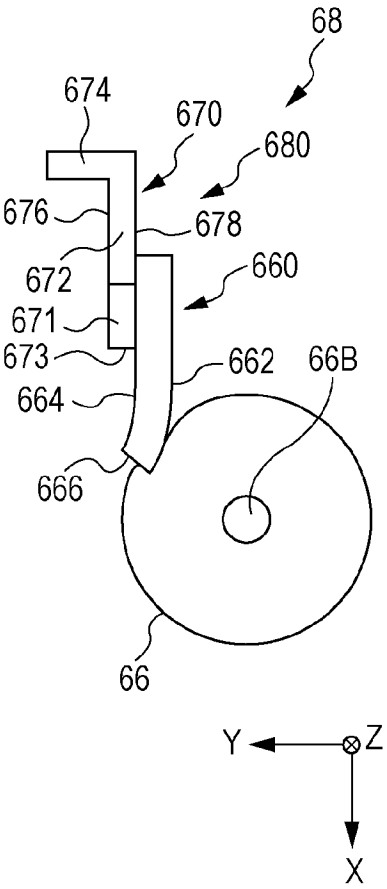
FIGS. 3A and 3B are a bottom view and a front view, respectively, of a second transfer device according to the exemplary embodiment of the present invention.
Figure 3A:
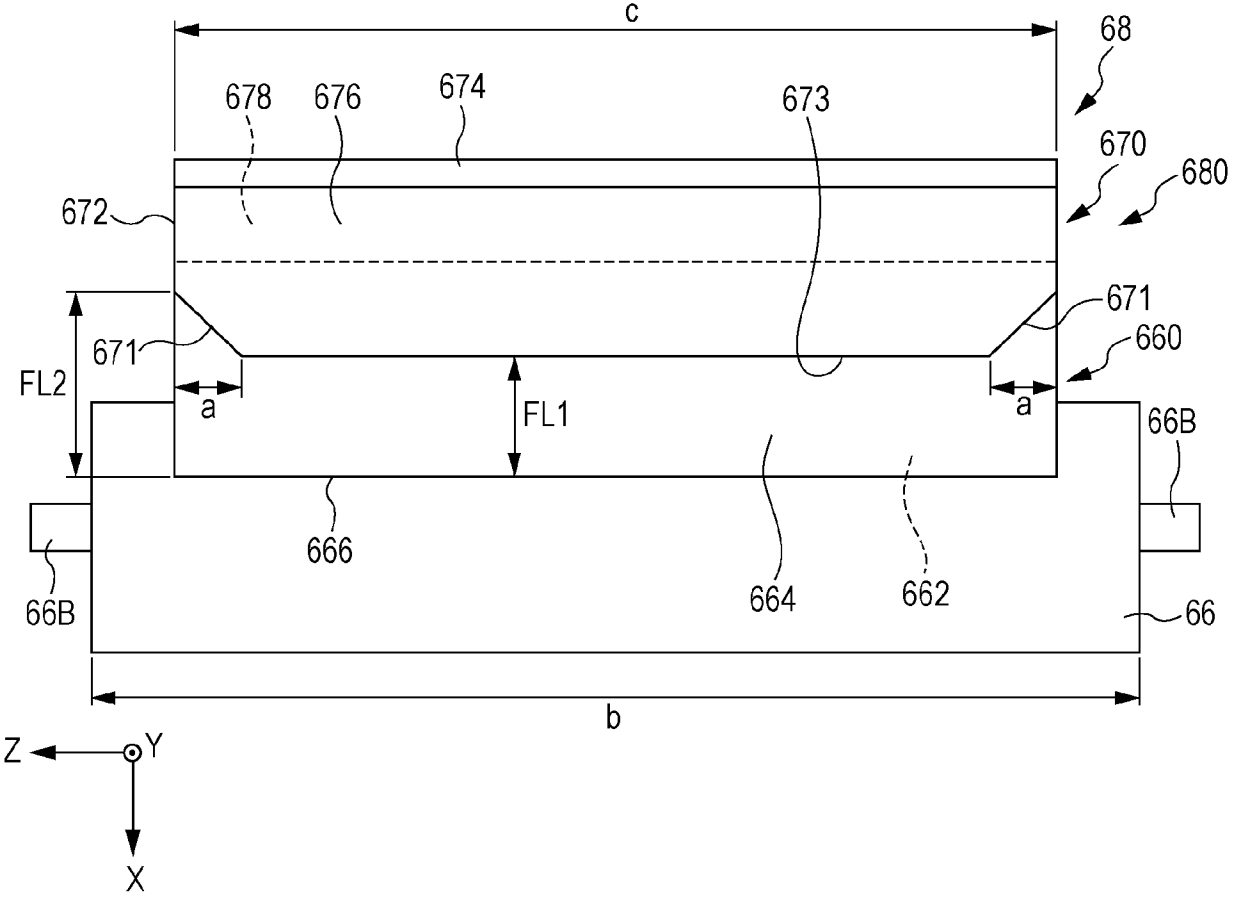

FIGS. 3A and 3B illustrate the second transfer device 68 according to the exemplary embodiment of the present invention. FIG. 3A is a schematic diagram (bottom view) of the second transfer device 68 viewed from below in the height direction of the image forming apparatus 10. FIG. 3B is a schematic diagram of the second transfer device 68 viewed from the right side in FIG. 3A. FIGS. 3A and 3B illustrate the state in which the cleaning blade 660 contacts and presses the outer peripheral surface of the second transfer roller 66 at a predetermined position.

Figure 4A:
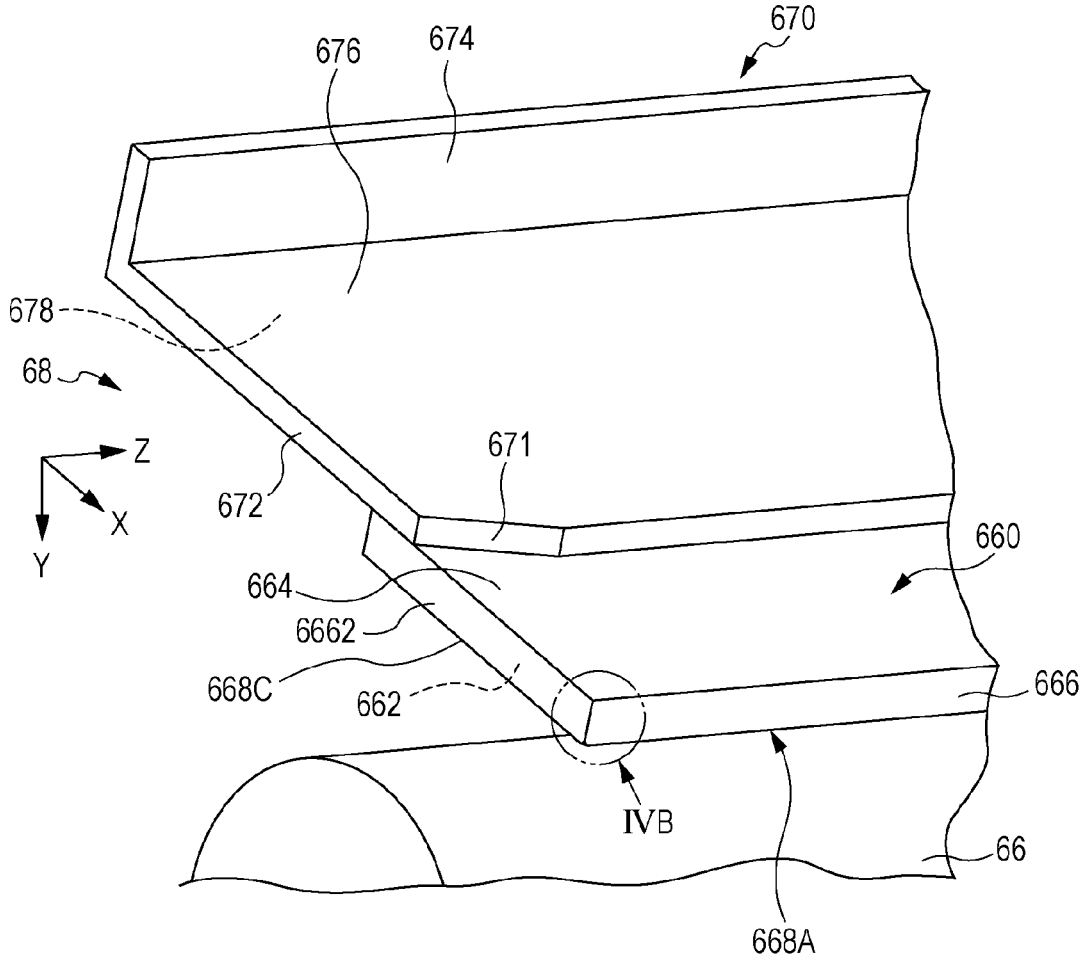
FIGS. 4A and 4B are a schematic perspective view and an enlarged view, respectively, of the second transfer device according to the exemplary embodiment of the present invention.
Figure 4B:
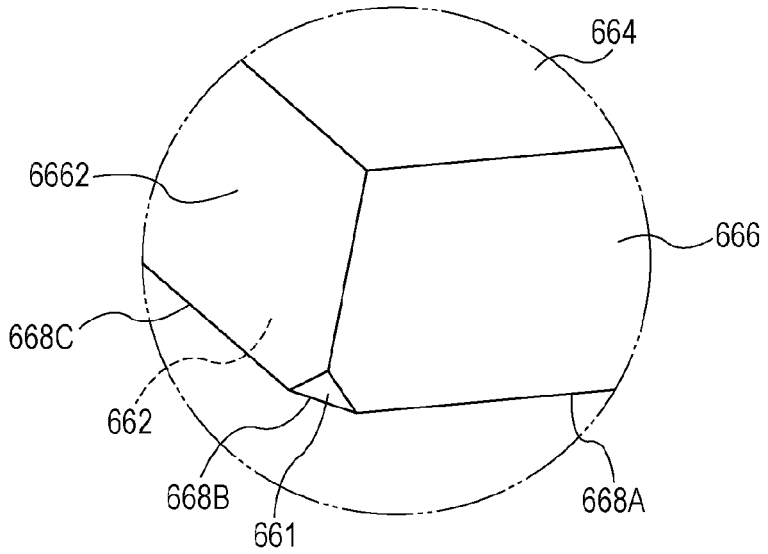

Similar to FIGS. 3A and 3B, FIGS. 4A and 4B also illustrate the second transfer device 68 according to the exemplary embodiment of the present invention. FIG. 4A is a schematic perspective view, and FIG. 4B is an enlarged view of part IVB that is surrounded by a two-dot chain line in FIG. 4A. Unlike FIGS. 3A and 3B, FIGS. 4A and 4B illustrate the state in which the cleaning blade 660 is not in contact with the outer peripheral surface of the second transfer roller 66 for convenience of explanation of the cleaning blade 660 and the cleaning unit 680.

Cleaning Blade

Referring to FIG. 3A, the cleaning blade 660 is a long member that is arranged such that the longitudinal direction thereof extends in the axial direction of the shaft 66B of the second transfer roller 66. As illustrated in FIGS. 3B and 4A, the cleaning blade 660 has a predetermined thickness. Specifically, the cleaning blade 660 has a front surface 662 that faces the outer peripheral surface of the second transfer roller 66, a back surface 664 that is opposite the front surface 662, and four side surfaces that extend along the thickness direction of the cleaning blade 660. The areas of the front surface 662 and the back surface 664 are larger than those of the four side surfaces.

The cleaning blade 660, which has the above-described six surfaces, has four ridgelines that extend in the longitudinal direction of the cleaning blade 660. Here, one of the four ridgelines that is formed between the front surface 662 and a side surface 666 is defined as a first ridgeline 668A. As illustrated in FIG. 4B, a chamfered portion 661 is formed at one end of the first ridgeline 668A in the longitudinal direction. Another chamfered portion 661 is formed at the other end of the first ridgeline 668A of the cleaning blade 660 in the longitudinal direction so that the cleaning blade 660 is symmetric about a vertical line when viewed in the lateral direction of the cleaning blade 660.

Referring to FIG. 4B, each chamfered portion 661 is formed by chamfering a corner defined by three surfaces, which are the front surface 662, the side surface 666, and a side surface 6662, so that the chamfered portion 661 has a chamfer dimension of 0.1 mm. Accordingly, three ridgelines are formed between the chamfered portion 661 and the three surfaces, and the chamfered portion 661 has a triangular shape. The ridgeline formed between the front surface 662 and the chamfered portion 661 is defined as a second ridgeline 668B.

From another point of view, the second ridgeline 668B extends along the front surface 662 and is at an angle relative to the first ridgeline 668A (see FIG. 4B). The ridgeline including the first ridgeline 668A and the second ridgelines 668B at both ends of the first ridgeline 668A is defined as a ridgeline part 668.

Each second ridgeline 668B connects the first ridgeline 668A to a third ridgeline 668C (see FIGS. 4A and 4B) that extends in the lateral direction of the cleaning blade 660. The second ridgeline 668B is formed by chamfering the corner defined by three surfaces, which are the front surface 662, the side surface 666, and the side surface 6662.

Blade Holder and Cleaning Unit

As illustrated in FIG. 3A, the blade holder 670 is a long plate. As illustrated in FIGS. 3B and 4A, the blade holder 670 has a predetermined thickness. The blade holder 670 includes a blade holder body 672 and a bent portion 674 that is provided at one end of the blade holder body 672 in the lateral direction of the blade holder body 672. The bent portion 674 is formed by a bending process to increase the rigidity of the blade holder 670.

An end face of the blade holder 670 at an end opposite to the end at which the bent portion 674 is provided is defined as an end face 673. End surfaces 671 formed by cutting off corners of the blade holder 670 are formed at both ends of the end face 673 in the longitudinal direction. The end surfaces 671 are at an angle relative to the longitudinal direction of the blade holder body 672.

Here, a surface of the blade holder body 672 from which the bent portion 674 projects is defined as a back surface 676, and a surface at a side opposite to the side of the back surface 676 is defined as a front surface 678. The blade holder 670 is an example of a support body. An end section (end face 673) of the blade holder 670 at an end where the end surfaces 671 are formed in the lateral direction is an example of an end section of the blade holder 670 that opposes the second transfer roller 66.

A part of the back surface 664 of the cleaning blade 660 is bonded to the front surface 678 of the blade holder body 672 of the blade holder 670 with an adhesive (not shown), so that the cleaning blade 660 is held by the blade holder 670.

Specifically, the cleaning blade 660 is held by the blade holder 670 such that the side surface 666 of the cleaning blade 660 projects from an end section of the blade holder 670 at a side opposite to the side at which the bent portion 674 is provided (see FIGS. 3A, 3B, and 4A). The cleaning blade 660 is held such that the longitudinal directions of the cleaning blade 660 and the blade holder 670 are parallel to each other.

The cleaning blade 660 and the blade holder 670 have the same length in the longitudinal direction thereof. The cleaning unit 680 is symmetric about a vertical line when viewed in the lateral direction of the cleaning blade 660 (or of the blade holder 670).

When viewed in the width direction of the image forming apparatus 10, the width a of each end surface 671 is greater than the width of each second ridgeline 668B (see FIGS. 3A and 4A). The blade holder 670 extends parallel to the first ridgeline 668A and does not contact the first ridgeline 668A or the second ridgelines 668B. The distance between each second ridgeline 668B and the blade holder 670 is greater than the distance between the first ridgeline 668A and the blade holder 670. When viewed in the width direction of the image forming apparatus 10, a length FL2 by which the cleaning blade 660 projects from the blade holder 670 at the position of each second ridgeline 668B is greater than a length FL1 by which the cleaning blade 660 projects from the blade holder 670 at the position of the first ridgeline 668A. The length by which the cleaning blade 660 projects from the blade holder 670 is referred to also as a free length of the cleaning blade 660.

Second Transfer Device

The second transfer device 68 includes the cleaning unit 680 and the second transfer roller 66. The second transfer roller 66 rotates around the shaft 66B when the intermediate transfer belt 62 rotates.

As illustrated in FIG. 3A, the length c of the cleaning unit 680 in the longitudinal direction is smaller than the length b of the outer peripheral surface of the second transfer roller 66 in the axial direction. The cleaning blade 660 contacts the outer peripheral surface of the second transfer roller 66 without protruding from the outer peripheral surface of the second transfer roller 66 (see FIG. 3A).

The cleaning unit 680 is disposed at a predetermined position such that the longitudinal direction thereof is parallel to the shaft 66B of the second transfer roller 66. Specifically, the blade holder 670 included in the cleaning unit 680 is positioned relative to a housing (not shown) of the intermediate transfer device 50.

Accordingly, a portion of the cleaning blade 660 that projects from the blade holder 670 contacts the outer peripheral surface of the second transfer roller 66 while being pressed by the outer peripheral surface and bent in a direction away from the outer peripheral surface, as illustrated in FIG. 3B. The ridgeline part 668 (the first ridgeline 668A and the second ridgelines 668B) of the cleaning blade 660 presses into the outer peripheral surface of the second transfer roller 66. In other words, parts of the surfaces along the first ridgeline 668A (the side surface 666 and the front surface 662) and a surface along each second ridgeline 668B (the front surface 662) and the entire chamfered portion 661 also press into the outer peripheral surface of the second transfer roller 66. Parts of the side surface 666 and the front surface 662 along the first ridgeline 668A, and parts of the chamfered portion 661 and the front surface 662 along each second ridgeline 668B define a corner portion of the cleaning blade 660 on which the ridgeline part 668 is formed.

The state in which the ridgeline part 668 of the cleaning blade 660 presses into the outer peripheral surface of the second transfer roller 66 means the following state. That is, when the second transfer device 68 is viewed in the depth direction of the image forming apparatus 10, the above-described state is the state in which the chamfered portion 661 of the cleaning blade 660 on the outer peripheral surface of the second transfer roller 66 is closer to the shaft 66B of the second transfer device 68 than an imaginary line that corresponds to the outer periphery of the second transfer device 68 in a state before the deformation.

Accordingly, each second ridgeline 668B extends from the first ridgeline 668A in a direction away from the second transfer roller 66 (the outer peripheral surface of the second transfer roller 66).

FIG. 3B illustrates the state in which the cleaning blade 660 is pressed into the outer peripheral surface of the second transfer roller 66. To facilitate understanding of the above-described description, in FIG. 3B, the amount by which the cleaning blade 660 is bent and the amount by which the second transfer roller 66 is dented (pressed inward) are exaggerated.

Operation

The operation according to the exemplary embodiment of the present invention will now be described.

When the image forming operation of the image forming apparatus 10 is started and the intermediate transfer belt 62 starts to rotate, the second transfer roller 66 is rotated around the shaft 66B by the rotation of the intermediate transfer belt 62. The cleaning unit 680, which has the above-described structure, is disposed at a predetermined position relative to the second transfer roller 66 and presses the outer peripheral surface of the second transfer roller 66 while the ridgeline part 668 of the cleaning blade 660 is in contact with the outer peripheral surface of the second transfer roller 66. Accordingly, a corner portion of the cleaning blade 660 on which the ridgeline part 668 is formed presses into the outer peripheral surface of the second transfer roller 66 and pushes the outer peripheral surface of the second transfer roller 66. Thus, the outer peripheral surface of the second transfer roller 66 is deformed by being pressed by a part of the cleaning blade 660.

The toner, dust, etc. that have adhered to the outer peripheral surface of the second transfer roller 66, which rotates around the shaft 66B in the deformed state, are removed by coming into contact with the first ridgeline 668A and the second ridgelines 668B on the cleaning blade 660.

In, for example, a cleaning blade that differs from the cleaning blade 660 having the above-described structure in that no second ridgeline is provided at each end of a first ridgeline, corners are formed at both ends of the cleaning blade, and large stress is generated at these corners. Therefore, end portions of this cleaning blade (the corners in this case) easily curl owing to friction between the outer peripheral surface of the second transfer roller 66 that rotates and the end portions.

In contrast, the stress applied to end portions of the cleaning blade 660 having the above-described structure is smaller than that in the case where the no second ridgeline is provided at each end of the first ridgeline.

Friction between the cleaning blade and the outer peripheral surface of the second transfer roller may be reduced by applying a lubricant (not shown), such as zinc stearate, on the outer peripheral surface of the second transfer roller. In such a case, according to the cleaning blade 660 having the above-described structure, the amount of lubricant to be applied to the outer peripheral surface of the second transfer roller 66 may be less than that in the case where the ridgeline part, in which the second ridgelines are formed at the ends of the first ridgeline, and the corner portion on which the ridgeline part is formed are not caused to press into the outer peripheral surface of the second transfer roller 66. Alternatively, the lubricant applied to the outer peripheral surface of the second transfer roller 66 may be omitted.

As described above, in the state in which the cleaning blade 660 is held by the blade holder 670, the free length FL2 at the position of each second ridgeline 668B is longer than the free length FL1 at the position of the first ridgeline 668A. As illustrated in FIG. 3B, the cleaning blade 660 contacts the outer peripheral surface of the second transfer roller 66 while being pressed by the outer peripheral surface and bent in a direction away from the outer peripheral surface. With this structure, the pressing force applied to the outer peripheral surface of the second transfer roller 66 is set so as to be smaller at each second ridgeline 668B, at which the free length is large, than at the first ridgeline 668A, at which the free length is small.

Thus, according to the cleaning blade 660 having the above-described structure and the cleaning unit 680 having the above-described structure, the stress applied at each second ridgeline may be set so as to be closer to the stress applied at the first ridgeline than in the case where the pressing force applied at each second ridgeline is not set so as to be smaller than the pressing force applied at the first ridgeline.

According to the second transfer device 68 having the above-described structure, defective transferring may be suppressed compared to the case where the above-described structure is not provided. According to the intermediate transfer device 50 including the second transfer device 68 having the above-described structure, defective intermediate transferring may be suppressed compared to the case where the above-described structure is not provided. According to the image forming apparatus 10 including the second transfer device 68 having the above-described structure, formation of defective images may be suppressed compared to the case where the above-described structure is not provided.

The second transfer device 68 having the above-described structure may have a higher durability than in the case where the above-described structure is not provided. The intermediate transfer device 50 including the second transfer device 68 having the above-described structure may have a higher durability than in the case where the above-described structure is not provided. The image forming apparatus 10 including the second transfer device 68 having the above-described structure may have a higher durability than in the case where the above-described structure is not provided.

First Modifications

Modifications (first modifications) of the exemplary embodiment of the present invention will now be described with reference to FIGS. 5A to 5E. Differences between the first modifications and the above-described structure will be basically described.

FIGS. 5A to 5E illustrate cleaning units 680A to 680E according to modifications of the cleaning unit 680. Similar to FIGS. 3A and 3B, FIGS. 5A to 5E show schematic diagrams (bottom views) of the cleaning units 680A to 680E viewed from below in the height direction of the image forming apparatus 10 and schematic diagrams of the cleaning units 680A to 680E viewed from the right side in the bottom views. Each of the cleaning units 680A to 680E has a shape that is symmetric about a vertical line when viewed in the lateral direction thereof. FIGS. 5A to 5E respectively show one ends of the cleaning units 680A to 680E in the longitudinal direction.

Figure 5A:
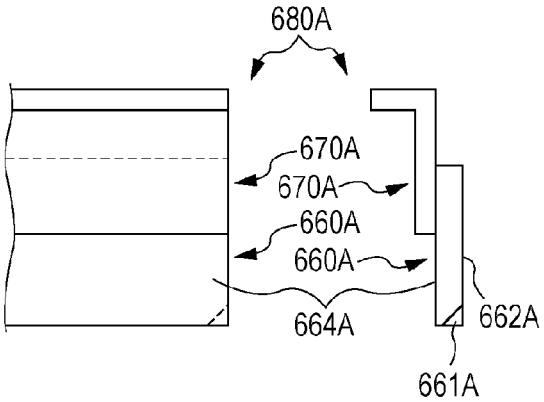
FIGS. 5A, 5B, 5C, 5D, and 5E illustrate modifications (first modifications) of a cleaning unit according to the exemplary embodiment of the present invention.

The cleaning unit 680A illustrated in FIG. 5A differs from the cleaning unit 680 having the above-described structure in that no end surfaces 671 are formed at the ends of a blade holder 670A. Effects of this modification are similar to those of the exemplary embodiment of the present invention achieved because the second ridgelines 668B are provided at both ends of the first ridgeline 668A of the cleaning blade 660.

Figure 5D:
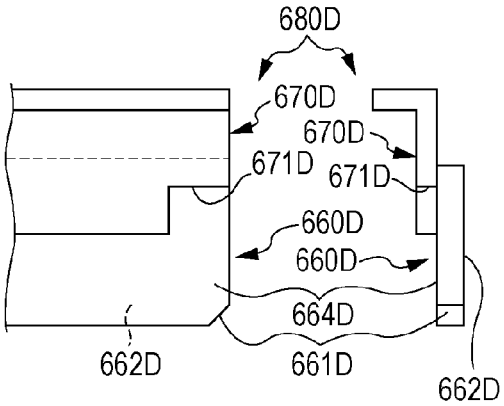
Figure 5B:
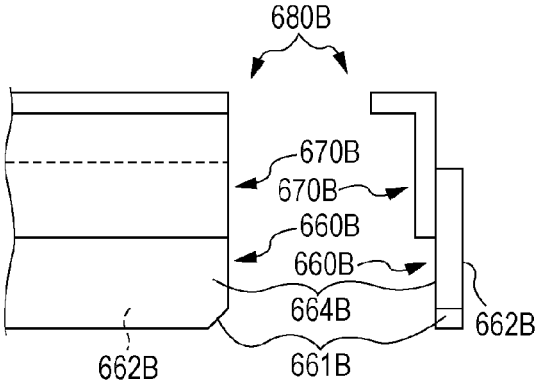

The cleaning unit 680B illustrated in FIG. 5B differs from the cleaning unit 680 having the above-described structure in that no end surfaces 671 are formed at the ends of a blade holder 670B. The cleaning unit 680B also differs from the cleaning unit 680 in that a chamfered portion 661B provided at each end of a first ridgeline of a cleaning blade 660B has a rectangular shape such that a ridgeline is formed between the chamfered portion 661B and a back surface 664B. In this case, since each chamfered portion 661B has a rectangular shape, a part of the chamfered portion 661B, instead of the entire chamfered portion 661B, contacts the outer peripheral surface of the second transfer roller 66. Effects of this modification are similar to those of the exemplary embodiment of the present invention achieved because the second ridgelines 668B are provided at both ends of the first ridgeline 668A of the cleaning blade 660.

Figure 5E:
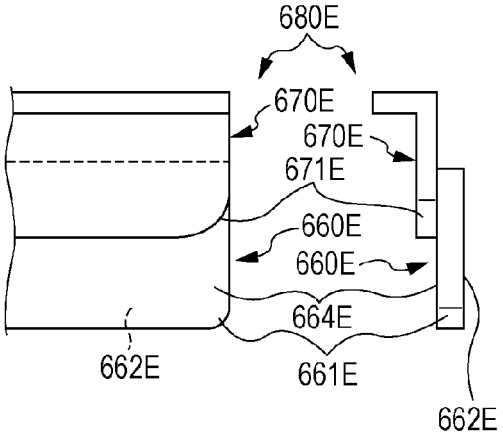
Figure 5C:
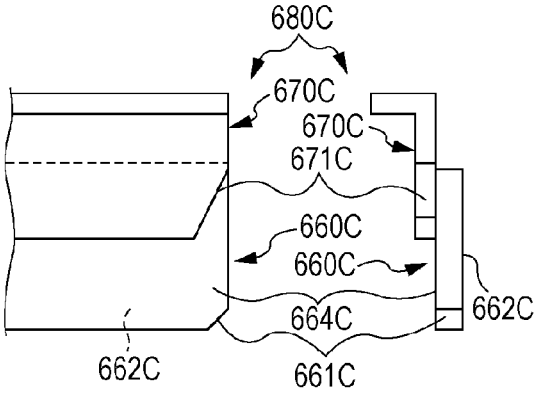

The cleaning unit 680C illustrated in FIG. 5C differs from the cleaning unit 680 having the above-described structure in that a chamfered portion 661C provided at each end of a first ridgeline of a cleaning blade 660C has a rectangular shape such that a ridgeline is formed between the chamfered portion 661C and a back surface 664C. In this case, since each chamfered portion 661C has a rectangular shape, a part of the chamfered portion 661C, instead of the entire chamfered portion 661C, contacts the outer peripheral surface of the second transfer roller 66. Effects of this modification are similar to those of the exemplary embodiment of the present invention.

The cleaning unit 680D illustrated in FIG. 5D differs from the cleaning unit 680 having the above-described structure in that a stepped end surface 671D is formed at each end of the blade holder 670D. Effects of this modification are similar to those of the exemplary embodiment of the present invention achieved because the end surfaces 671 are provided at both ends of the blade holder 670.

The cleaning unit 680D also differs from the cleaning unit 680 in that a chamfered portion 661D provided at each end of a first ridgeline of a cleaning blade 660D has a rectangular shape such that a ridgeline is formed between the chamfered portion 661D and a back surface 664D. In this case, since each chamfered portion 661D has a rectangular shape, a part of the chamfered portion 661D, instead of the entire chamfered portion 661D, contacts the outer peripheral surface of the second transfer roller 66. Effects of this modification are similar to those of the exemplary embodiment of the present invention achieved because the second ridgelines 668B are provided at both ends of the first ridgeline 668A of the cleaning blade 660.

The cleaning unit 680E illustrated in FIG. 5E differs from the cleaning unit 680 having the above-described structure in that an end surface 671E having a rounded shape (R2 mm) is formed at each end of a blade holder 670E. The cleaning unit 680E also differs from the cleaning unit 680 in that an end portion 661E provided at each end of a first ridgeline of a cleaning blade 660E has a rounded shape (R0.1 mm) such that a ridgeline is formed between the end portion 661E and a back surface 664E. In this case, since each end portion 661E has a rounded shape, a part of the end portion 661E, instead of the entire end portion 661E, contacts the outer peripheral surface of the second transfer roller 66. Effects of this modification are similar to those of the exemplary embodiment of the present invention.

Combinations of structures of the first modifications (combinations of the shape of each chamfered portion of the cleaning blade and the shape of each end portion of the blade holder) are examples, and other combinations of the structures of the first modifications are also possible. Although not described in the exemplary embodiment and first modifications according to the present invention, each chamfered portion of the cleaning blade is not limited to a planar surface, and may instead by a spherical surface, a polygonal surface, or a combination thereof.

Although not illustrated in the first modifications, in the case where the corners of the cleaning blade are formed in a spherical shape, the second ridgelines are lines that are on the front surface of the cleaning blade and that do not extend in the longitudinal direction of the first ridgeline or the longitudinal direction of the third ridgelines. In this case, since the corners of the cleaning blade are formed in a spherical shape, the second ridgelines have an arc shape.

The second ridgelines are not limited as long as they are formed at both ends of the first ridgeline, extend in directions other than the longitudinal direction of the first ridgeline, and may be pressed into the outer peripheral surface of the second transfer roller 66. For example, the second ridgelines are not limited to lines on the front surface of the cleaning blade, and may instead be lines on the side surface along the first ridgeline. In the cleaning blade 660 illustrated in FIGS. 4A and 4B, the line between the side surface 666 and the chamfered portion 661 may be defined as a second ridgeline.

Second Modification

A second modification of the exemplary embodiment of the present invention will now be described with reference to FIGS. 6A and 6B. Differences between the second modification and the above-described structure will be basically described.

Figure 6A:
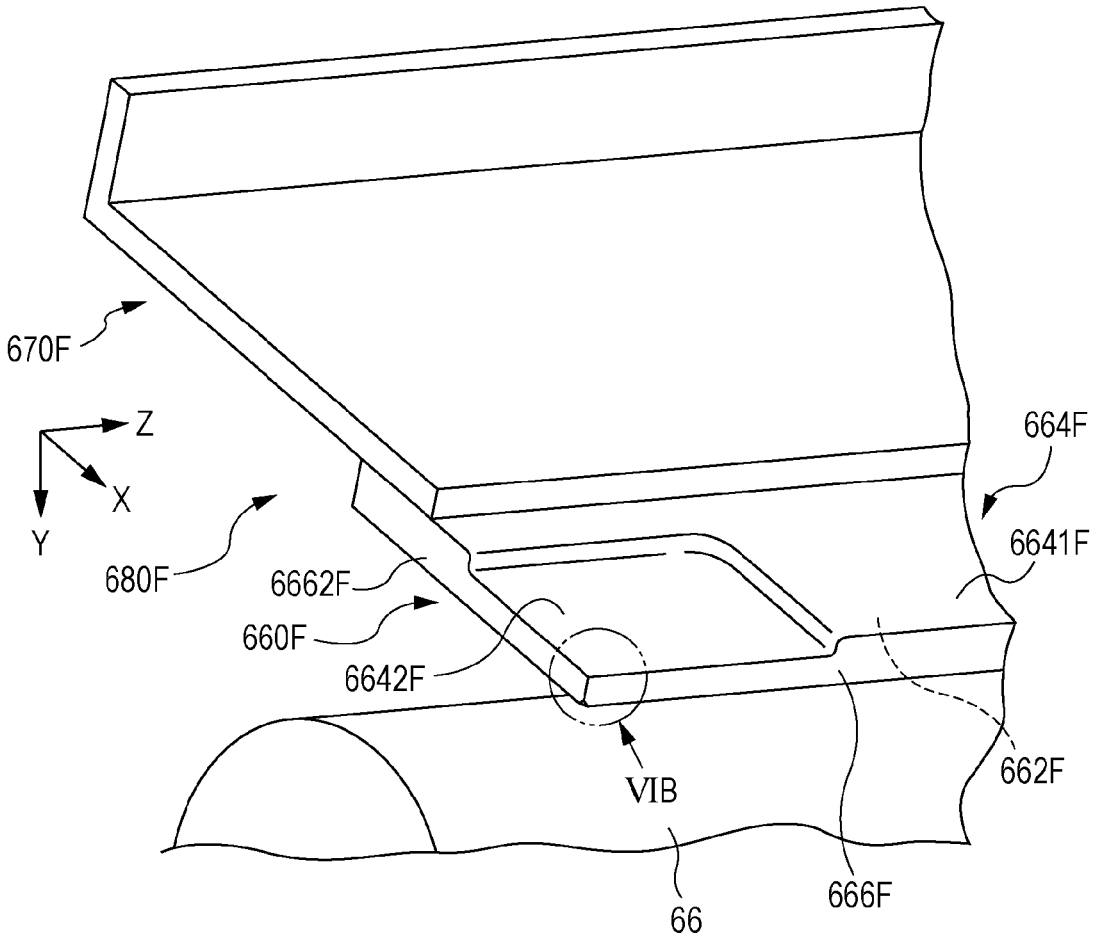
FIGS. 6A and 6B are perspective views illustrating a modification (second modification) of a transfer device according to the exemplary embodiment of the present invention.
Figure 6B:
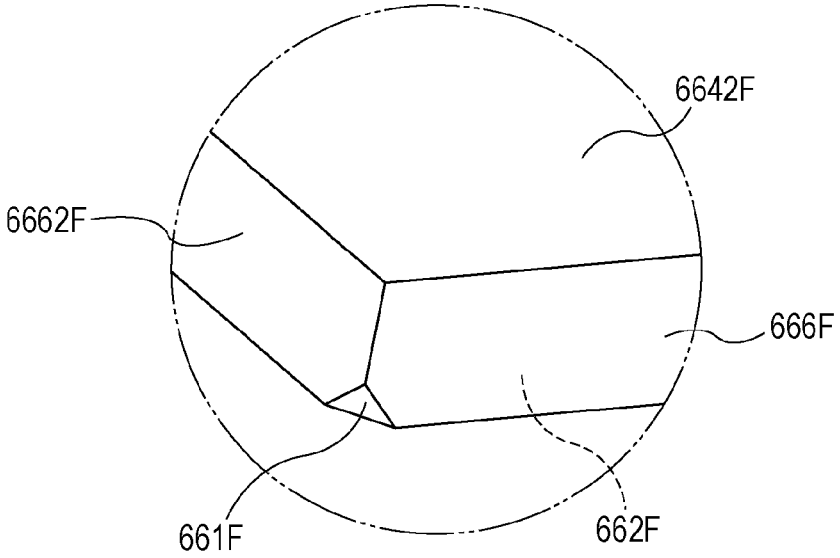

A cleaning unit 680F illustrated in FIGS. 6A and 6B differs from the above-described structure in that no end surface is formed at each end of the blade holder 670F. The cleaning unit 680F also differs from the above-described structure in that a portion 6642F having a thickness different from that of other portions is formed on a back surface 664F of a cleaning blade 660F at each end of the cleaning blade 660F. Specifically, the portion 6642F corresponds to an end portion of a projecting part of the cleaning blade 660F in the longitudinal direction. The thickness of the portion 6642F is smaller than that of a central portion 6641F of the projecting part of the cleaning blade 660F in the longitudinal direction.

According to the cleaning blade 660F having the above-described structure, the stress applied at each second ridgeline may be set so as to be closer to the stress applied at the first ridgeline than in the case where the thickness of each end portion of the protruding part of the cleaning blade is not smaller than that of the central portion of the projecting part. Other effects are similar to those of the exemplary embodiment of the present invention and the first modifications.

The cleaning unit according to the second modification may have any of the shapes according to the exemplary embodiment of the present invention and the first modifications.

Third Modification

A third modification of the exemplary embodiment of the present invention will now be described with reference to FIG. 7. Differences between the third modification and the above-described structure will be basically described. Similar to FIGS. 3A and 5A to 5E, FIG. 7 illustrates a bottom view of a second transfer device 68B viewed from below in the height direction of the image forming apparatus 10.

Figure 7:
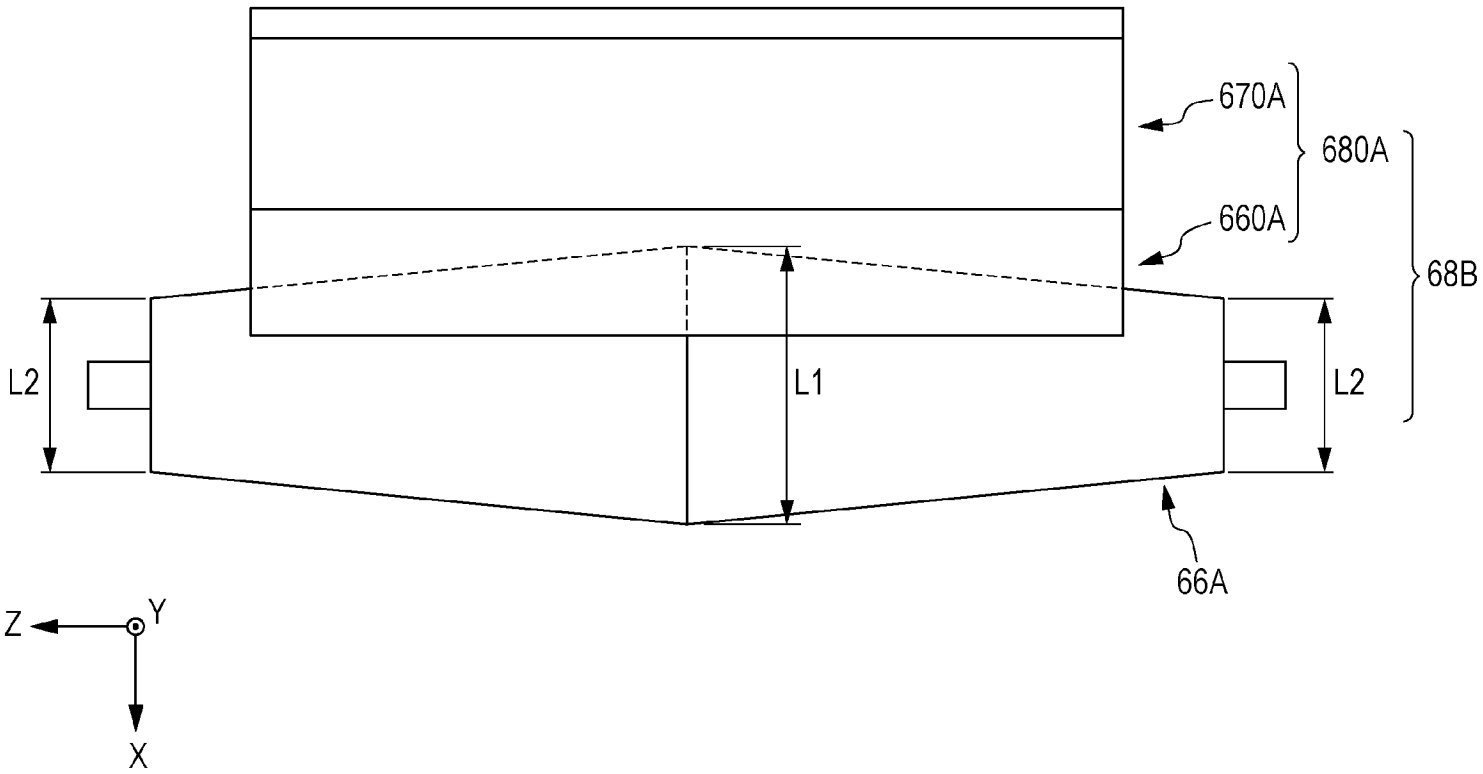
FIG. 7 is a perspective view illustrating a modification (third modification) of a transfer device according to the exemplary embodiment of the present invention.

As illustrated in FIG. 7, the second transfer device 68B is configured such that an outer diameter L2 of a second transfer roller 66A at both ends thereof is smaller than an outer diameter L1 of the second transfer roller 66A at the center thereof in the width direction of the image forming apparatus 10. The outer diameter of the second transfer roller 66A gradually decreases from the center toward the ends. The second transfer device 68B includes the above-described cleaning unit 680A according to a first modification (see FIG. 5A).

According to the second transfer device 68B having the above-described structure, in the structure in which no end surfaces are formed on the blade holder, the stress applied at each second ridgeline 668B of the cleaning blade 660A may be set so as to be closer to the stress applied at the first ridgeline 668A than in the case where the outer diameter of the second transfer roller is not smaller at both ends than at the center. Other effects are similar to those of the exemplary embodiment of the present invention and the first and second modifications.

The cleaning unit included in the second transfer device 68B according to the third modification may have any of the shapes according to the exemplary embodiment of the present invention, the first modifications, and the second modification.

Although a specific exemplary embodiment of the present invention has been described in detail, the present invention is not limited to the exemplary embodiment, and various exemplary embodiments are possible within the scope of the present invention. For example, the second transfer roller 66 may have a multilayer structure including, for example, a rubber layer on the outer peripheral surface of the foam layer.

Although the second transfer roller 66 is described as a member to be cleaned, the member to be cleaned may instead be a first transfer roller or a first transfer device including the first transfer roller. Alternatively, the member to be cleaned may be a transfer roller included in an image forming apparatus in which a single-color toner image is formed on an image carrier and transferred onto a recording medium that is being transferred instead of an image forming apparatus in which plural toner images of respective colors are transferred onto an intermediate transfer belt and a recording medium.

In the case where the belt cleaning device 71 that cleans the outer peripheral surface of the intermediate transfer belt 62 includes a rubber roller, the rubber roller may be a member to be cleaned. In the case where each photoconductor body 72 is charged with a charging roller, the charging roller may be a member to be cleaned.

EXAMPLES

Examples and comparative examples will now be described with reference to FIGS. 8 to 13. Comparative experiments are performed under the conditions shown in FIG. 8 to simulate Mises stress (MPa) versus time at each second ridgeline or each corner portion of a cleaning blade included in each of cleaning units according to examples and cleaning units according to comparative examples. In each of the examples and comparative examples, rubber hardness of the cleaning blade is 70° (JIS-A, Shore A), and hardness of the second transfer roller is 20° (Asker C).

Example 1

Figure 9A:
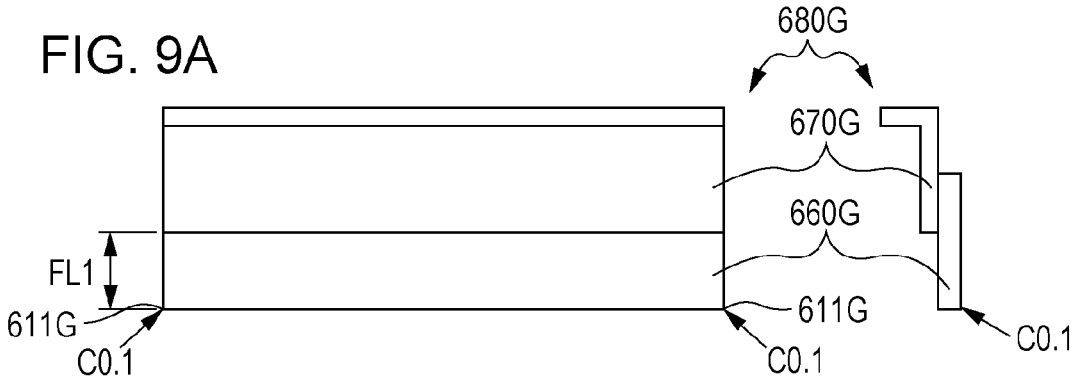
FIGS. 9A and 9B illustrate cleaning units according to the examples.

Referring to FIG. 8, according to Example 1, the simulation is performed by using a cleaning unit 680G illustrated in FIG. 9A.

According to FIG. 8, FL1=10 (mm), FL2=10 (mm), and a=0 (mm). This means that, as illustrated in FIG. 9A, no end surface is formed on a blade holder 670G. In addition, according to FIG. 8, the end shape is C0.1. This means that each chamfered portion 661G formed on a cleaning blade 660G has a chamfer dimension of 0.1 mm.

Figure 10:
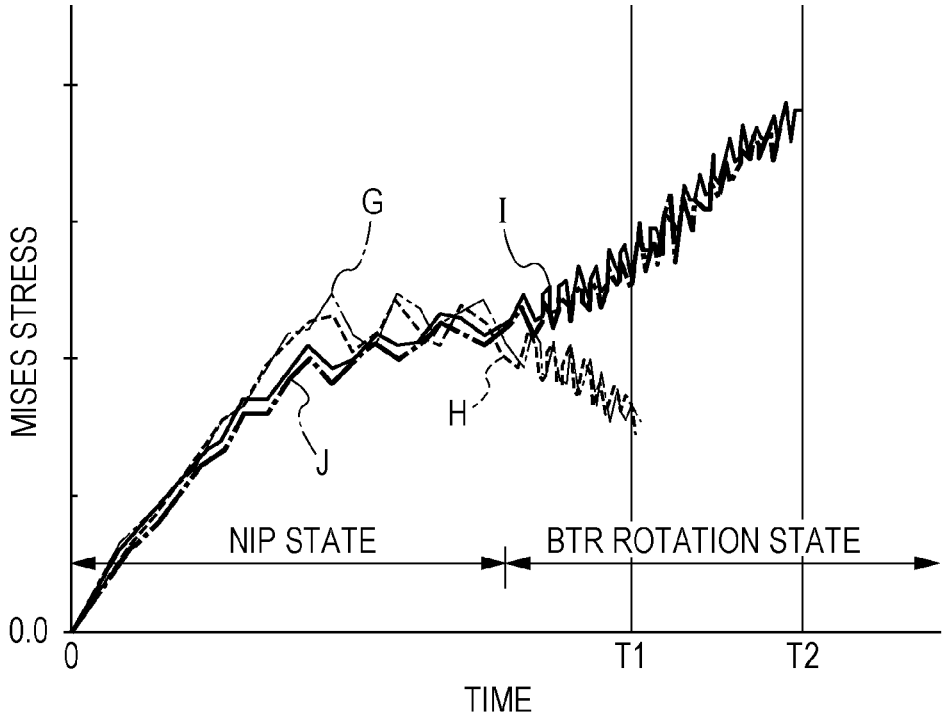
FIG. 10 is a graph showing results of simulation for the examples of the present invention and the comparative examples.

FIG. 10 is a graph showing the Mises stress versus time at each end portion of the cleaning blade. In the graph, NIP state is a state in which the second transfer roller is not rotated, and BTR rotation state is a state in which the second transfer roller is rotated. In this simulation, the Mises stress at each end portion of the cleaning blade is determined while the second transfer device is maintained in the NIP state for a certain period and then maintained in the BTR rotation state for a certain period.

Line G in FIG. 10 shows the simulation result of Example 1. The Mises stress at each end portion of the cleaning blade is lower in the state in which the second transfer roller is rotated than in the state in which the second transfer roller is not rotated. In addition, the Mises stress at each end portion of the cleaning blade in the state in which the second transfer roller is rotated is lower than those according to the comparative examples (lines I and J) described below.

Example 2

Figure 9B:
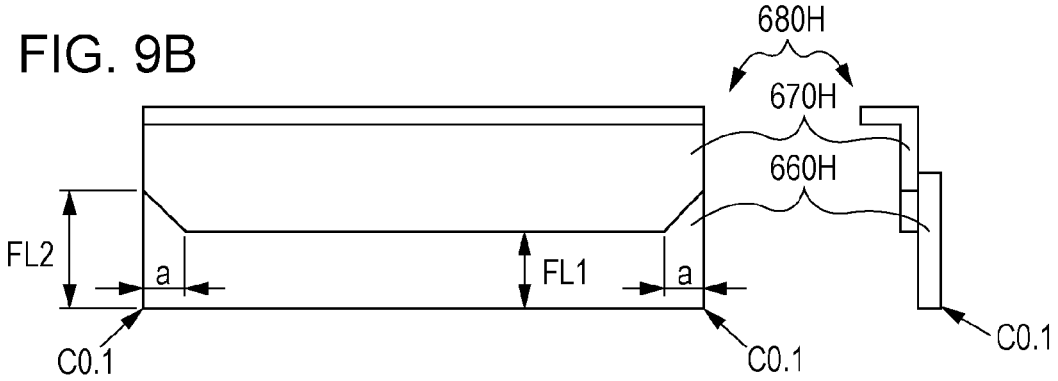

Referring to FIG. 8, according to Example 2, the simulation is performed by using a cleaning unit 680H illustrated in FIG. 9B.

Line H in FIG. 10 shows the simulation result of Example 2. The Mises stress at each end portion of the cleaning blade is lower in the state in which the second transfer roller is rotated than in the state in which the second transfer roller is not rotated. In addition, the Mises stress at each end portion of the cleaning blade in the state in which the second transfer roller is rotated is lower than those according to the comparative examples (lines I and J) described below.

Figure 11:
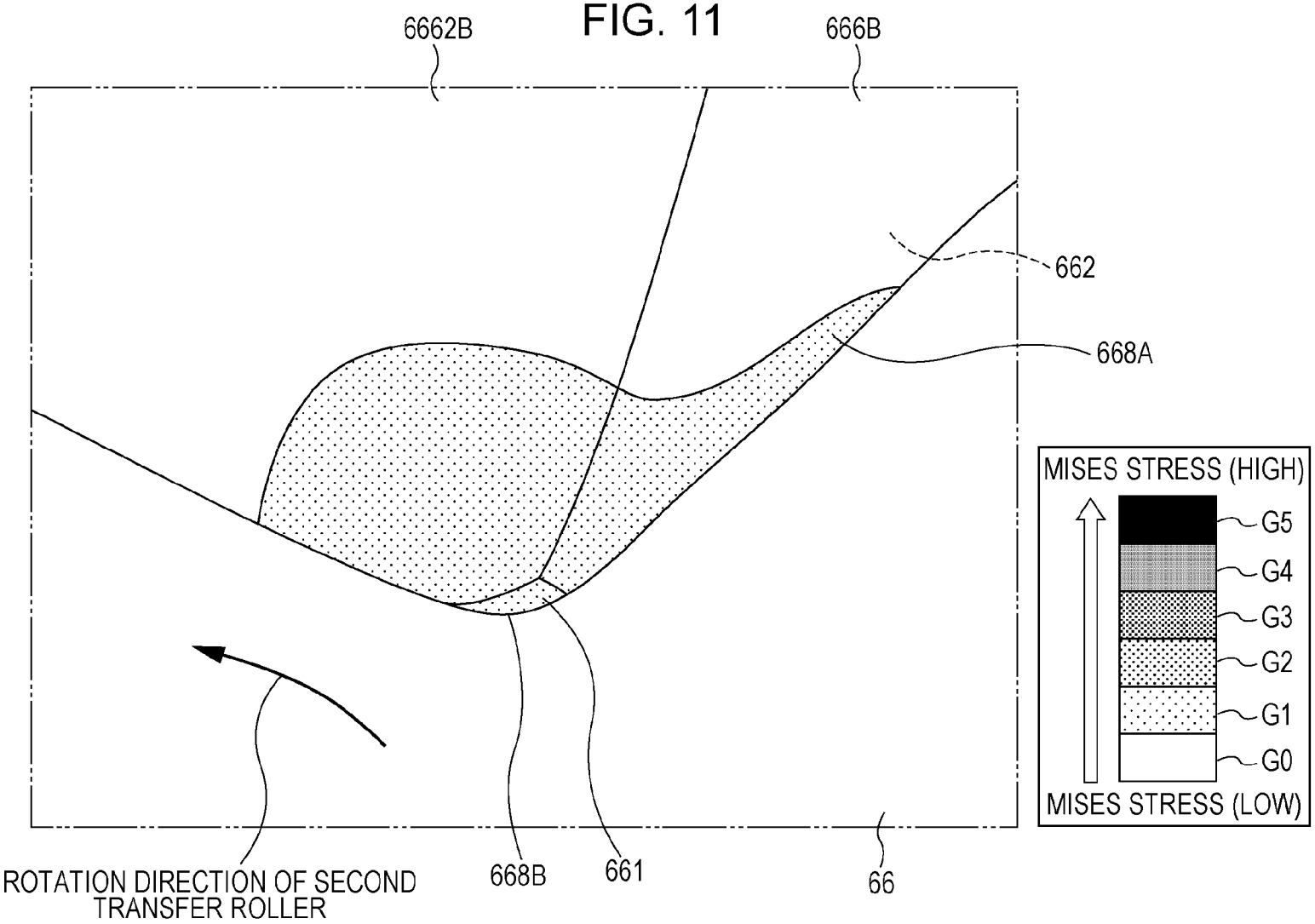
FIG. 11 is a perspective view showing a result of a simulation for a cleaning blade and a second transfer roller according to an example of the present invention.

FIG. 11 shows the distribution of Mises stress in a region around an end portion of the cleaning blade at time T1 (s) in FIG. 10.

Comparative Example 1

Figure 9C:
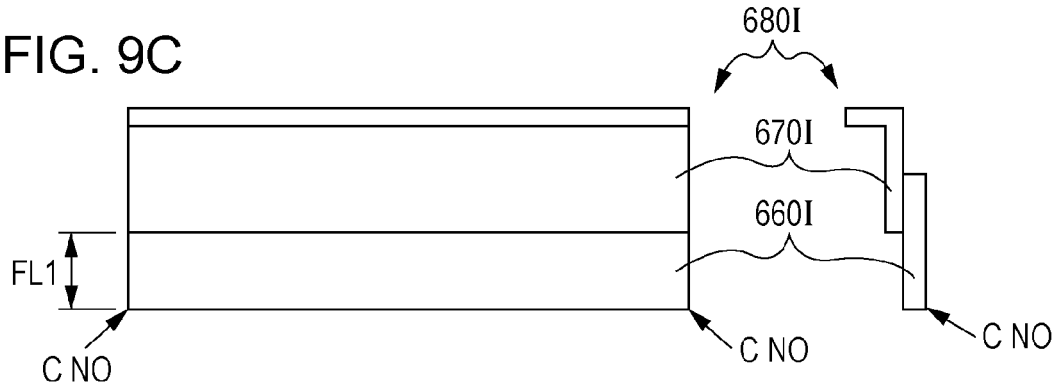
FIGS. 9C and 9D illustrate cleaning units according to the comparative examples.

Referring to FIG. 8, according to Comparative Example 1, the simulation is performed by using a cleaning unit 680I illustrated in FIG. 9C. According to FIG. 8, the end shape is a corner shape. This means that, unlike the cleaning blades 660, 660G, 660H, etc., each end portion of a cleaning blade 660I is not chamfered.

Line I in FIG. 10 shows the simulation result of Comparative Example 1. The Mises stress at each end portion of the cleaning blade is higher in the state in which the second transfer roller is rotated than in the state in which the second transfer roller is not rotated. In addition, the Mises stress at each end portion of the cleaning blade in the state in which the second transfer roller is rotated is higher than those according to the examples (lines G and H).

Figure 12:
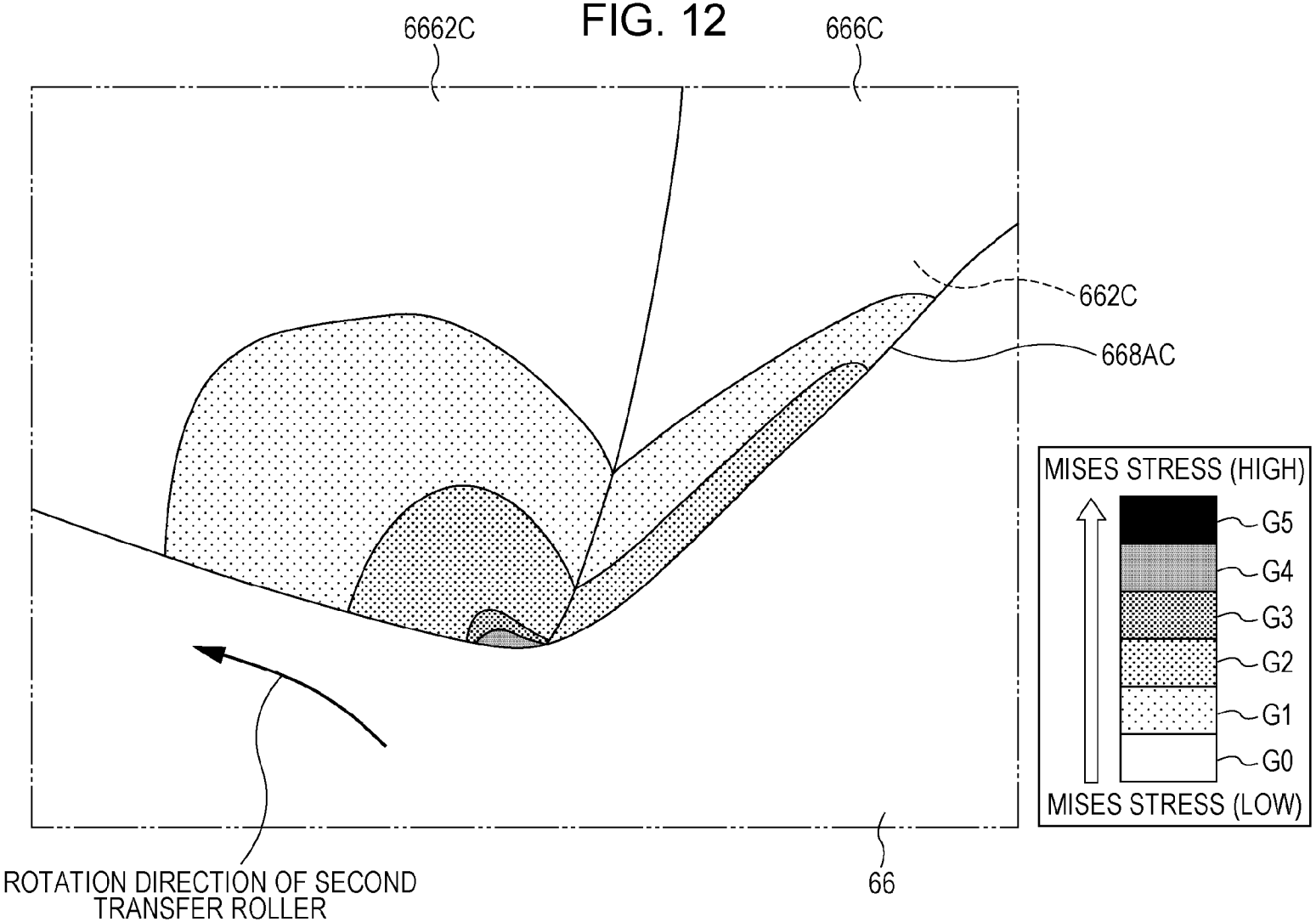
FIG. 12 is a perspective view showing a result of a simulation for a cleaning blade and a second transfer roller according to a comparative example.

FIG. 12 shows the distribution of Mises stress on side surfaces 666C and 6662C in a region around an end portion of the cleaning blade at time T1 (s) in FIG. 10.

Figure 13:
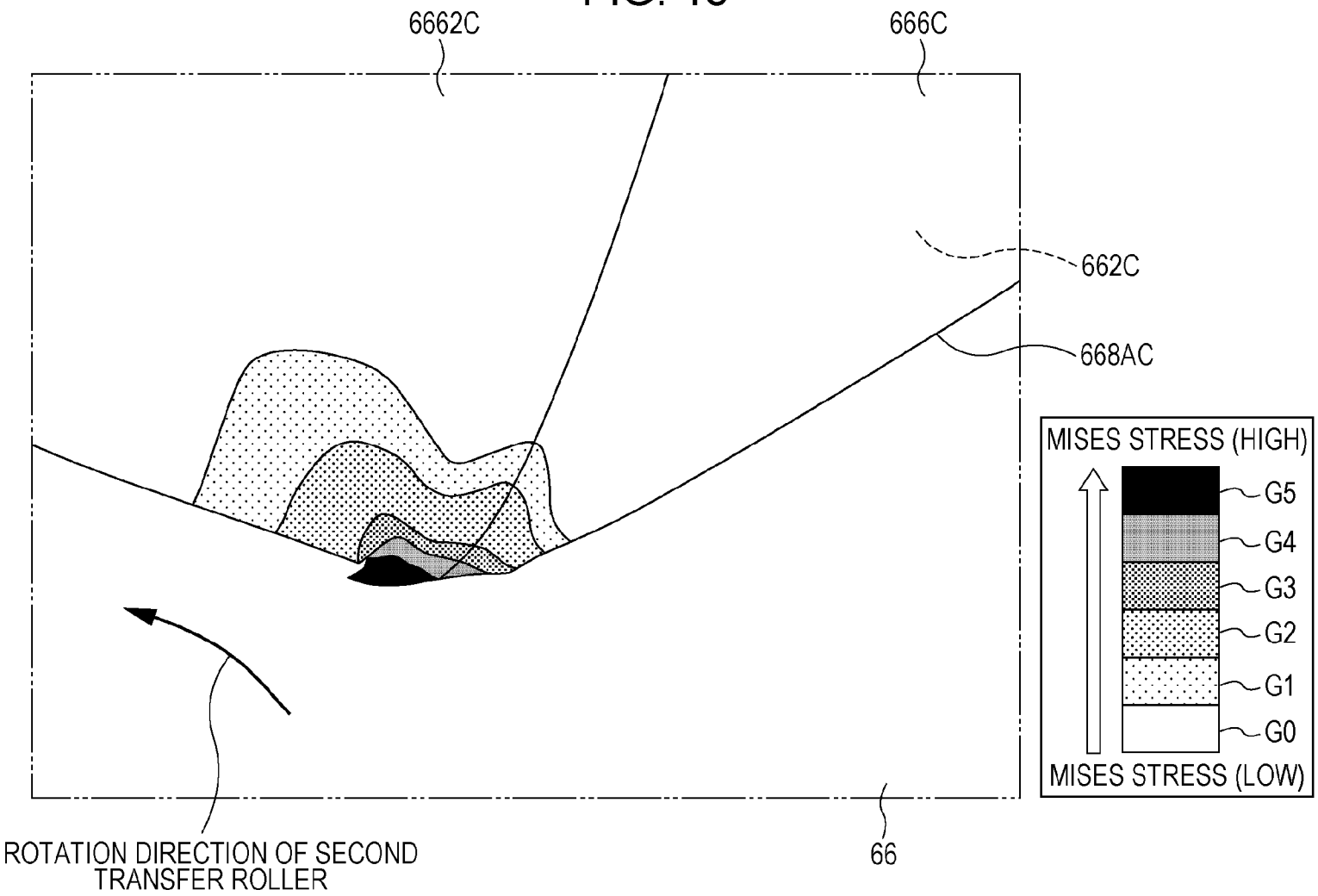
FIG. 13 is a perspective view showing a result of a simulation for a cleaning blade and a second transfer roller according to a comparative example.

FIG. 13 shows the distribution of Mises stress in the region around the end portion of the cleaning blade at time T2 (s) in FIG. 10. It is clear from FIG. 13 that with the elapse of time from T1 to T2, the Mises stress at the end portion of the cleaning blade 660I according to Comparative Example 1 increases and the end portion of the cleaning blade 660I curls as a result.

Comparative Example 2

Figure 9D:
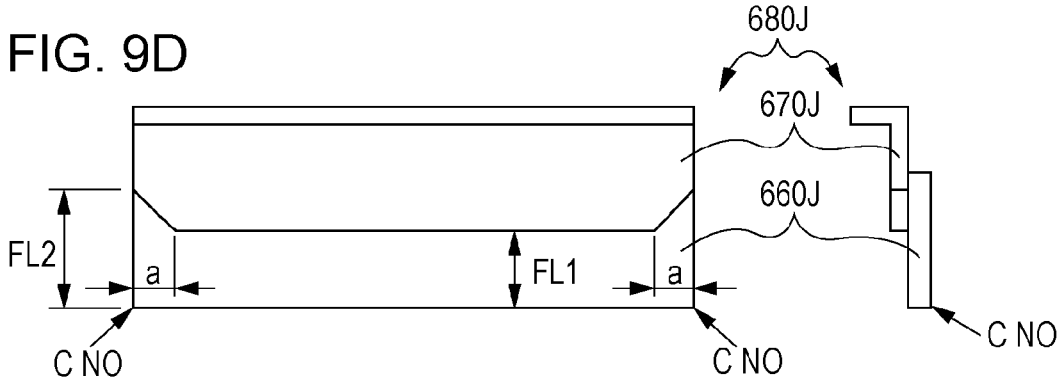

Referring to FIG. 8, according to Comparative Example 2, the simulation is performed by using a cleaning unit 680J illustrated in FIG. 9D.

Line J in FIG. 10 shows the simulation result of Comparative Example 2. The Mises stress at the end portion of the cleaning blade is higher in the state in which the second transfer roller is rotated than in the state in which the second transfer roller is not rotated. In addition, the Mises stress at the end portion of the cleaning blade in the state in which the second transfer roller is rotated is higher than those according to the examples (lines G and H).

The examples of the present invention have been described. According to the simulation of Examples 1 and 2, similar results are obtained irrespective of whether or not the end surfaces 671 are formed on the blade holder.

The simulation is performed to analyze the Mises stress in a region around each second ridgeline 668B or each end portion of the cleaning blade. According to the findings of the present inventor, to suppress curling of the cleaning blade 660, it is required not only to reduce the Mises stress in the region around each second ridgeline 668B or each end portion but also to reduce variation in the Mises stress in the region around the entire ridgeline part 668. From this viewpoint, in the structures according to the exemplary embodiment of the present invention, the first modifications (FIGS. 5C to 5E), and the second and third modifications, the pressing force applied to the cleaning blade 660 is set so as to be smaller at each second ridgeline 668B than at the first ridgeline 668A. Accordingly, the difference in stress between the central portion and each end portion of the ridgeline part 668 is reduced.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning member comprising:

a ridgeline part provided at one end of the cleaning member in a lateral direction of the cleaning member, the ridgeline part including:

a first ridgeline that extends in an axial direction of a member to be cleaned that is rotatable; and second ridgelines provided at respective ends of the first ridgeline, each of the second ridgelines extending in a direction away from the member to be cleaned, wherein the ridgeline part is configured to be pressed against an outer peripheral surface of the member to be cleaned so that the ridgeline part and a corner portion on which the ridgeline part is formed press onto the outer peripheral surface of the member to be cleaned and deform the member to be cleaned.

2. The cleaning member according to claim 1, further comprising:

third ridgelines that extend in the lateral direction at respective ends of the first ridgeline, wherein the second ridgelines connect the first ridgeline to the third ridgelines.

3. The cleaning member according to claim 2, wherein a pressing force applied at each second ridgeline is set so as to be smaller than a pressing force applied at the first ridgeline.

4. The cleaning member according to claim 3, wherein the cleaning member includes a cleaning body on which the ridgeline part is formed and a support body that supports the cleaning body such that the ridgeline part on the cleaning body protrudes from an end section of the support body that opposes the member to be cleaned, wherein the end section of the support body includes a first end portion that extends in the axial direction and second end portions formed at respective ends of the first end portion, and wherein an amount by which the cleaning body protrudes from each second end portion is greater than an amount by which the cleaning body protrudes from the first end portion.

5. The cleaning member according to claim 2, wherein the cleaning member includes a cleaning body on which the ridgeline part is formed and a support body that supports the cleaning body such that the ridgeline part on the cleaning body protrudes from an end section of the support body that opposes the member to be cleaned, wherein the end section of the support body includes a first end portion that extends in the axial direction and second end portions formed at respective ends of the first end portion, and wherein an amount by which the cleaning body protrudes from each second end portion is greater than an amount by which the cleaning body protrudes from the first end portion.

6. The cleaning member according to claim 1, wherein a pressing force applied at each second ridgeline is set so as to be smaller than a pressing force applied at the first ridgeline.

7. The cleaning member according to claim 6, wherein the cleaning member includes a cleaning body on which the ridgeline part is formed and a support body that supports the cleaning body such that the ridgeline part on the cleaning body protrudes from an end section of the support body that opposes the member to be cleaned, wherein the end section of the support body includes a first end portion that extends in the axial direction and second end portions formed at respective ends of the first end portion, and wherein an amount by which the cleaning body protrudes from each second end portion is greater than an amount by which the cleaning body protrudes from the first end portion.

8. The cleaning member according to claim 1, wherein the cleaning member includes a cleaning body on which the ridgeline part is formed and a support body that supports the cleaning body such that the ridgeline part on the cleaning body protrudes from an end section of the support body that opposes the member to be cleaned.

9. The cleaning member according to claim 8, wherein the end section of the support body includes a first end portion that extends in the axial direction and second end portions formed at respective ends of the first end portion, and wherein an amount by which the cleaning body protrudes from each second end portion is greater than an amount by which the cleaning body protrudes from the first end portion.

10. The cleaning member according to claim 8, wherein the cleaning body comprises the second ridgelines.

11. A transfer device comprising:

a transfer member configured to transfer a toner image on an image carrier onto a medium; and the cleaning member according to claim 1 in which the member to be cleaned is the transfer member.

12. An intermediate transfer device comprising:

an intermediate transfer body; and the transfer device according to claim 11, wherein the image carrier is the intermediate transfer body.

13. An image forming apparatus comprising:

an image carrier;

a charging unit configured to charge an outer peripheral surface of the image carrier;

a latent image forming unit configured to form a latent image on the outer peripheral surface of the image carrier that has been charged by the charging unit;

a developing unit configured to develop the latent image, which has been formed by the latent image forming unit, into a toner image with toner; and the transfer device according to claim 11, the transfer device being configured to transfer the toner image, which has been formed on the image carrier by the developing unit, onto the medium.

14. A cleaning blade that cleans a roller that is rotatable, the cleaning blade comprising:

a first ridgeline configured to contact the roller and which extends in a direction along a rotation axis of the roller; and a second ridgeline formed by chamfering a corner at an end of the first ridgeline, the second ridgeline being connected to the first ridgeline, wherein the cleaning blade is configured to clean the roller while the first ridgeline and the second ridgeline press onto an outer peripheral surface of the roller so that the roller is deformed.

15. The cleaning blade according to claim 14, wherein the cleaning blade has a surface that opposes the roller, wherein the surface has the first ridgeline that extends in a longitudinal direction and a third ridgeline that extends in a lateral direction, and wherein the second ridgeline connects the first ridgeline to the third ridgeline.

16. A cleaning member comprising:

a cleaning blade configured to clean a roller that includes a form elastic layer and that is rotatable; and a support body that supports the cleaning blade, wherein the cleaning blade includes:

a first ridgeline configured to contact the roller and which extends in a direction along a rotation axis of the roller, and a second ridgeline formed by chamfering a corner at an end of the first ridgeline, the second ridgeline being connected to the first ridgeline, wherein the cleaning blade is configured to clean the roller while the first ridgeline and the second ridgeline press onto an outer peripheral surface of the roller so that the roller is deformed, wherein the support body extends in a direction along the first ridgeline and does not contact the first ridgeline or the second ridgeline, and wherein a distance from the second ridgeline to the support body is greater than a distance from the first ridgeline to the support body.

* * * * *